US009132434B2

(12) United States Patent
Ranstad et al.

(10) Patent No.: US 9,132,434 B2
(45) Date of Patent: Sep. 15, 2015

(54) METHOD TO CONTROL THE LINE DISTORATION OF A SYSTEM OF POWER SUPPLIES OF ELECTROSTATIC PRECIPITATORS

(75) Inventors: Per Ranstad, Växjö (SE); Jörgen Linner, Växjö (SE)

(73) Assignee: ALSTOM Technology Ltd, Baden (CH)

( * ) Notice: Subject to any disclaimer, the term of this patent is extended or adjusted under 35 U.S.C. 154(b) by 429 days.

(21) Appl. No.: 13/701,143

(22) PCT Filed: Jun. 17, 2011

(86) PCT No.: PCT/EP2011/060136

§ 371 (c)(1),
(2), (4) Date: Mar. 25, 2013

(87) PCT Pub. No.: WO2011/157831

PCT Pub. Date: Dec. 22, 2011

(65) Prior Publication Data

US 2013/0206001 A1 Aug. 15, 2013

(30) Foreign Application Priority Data

Jun. 18, 2010 (EP) ..... 10166579

(51) Int. Cl.
*B03C 3/68* (2006.01)
*B03C 3/02* (2006.01)

(52) U.S. Cl.
CPC .. *B03C 3/68* (2013.01); *B03C 3/025* (2013.01)

(58) Field of Classification Search
CPC combination set(s) only.
See application file for complete search history.

(56) References Cited

U.S. PATENT DOCUMENTS

| | | | | | |
|---|---|---|---|---|---|
| 1,961,658 | A | | 6/1934 | Buff et al. | |
| 3,641,740 | A | * | 2/1972 | Schumann et al. | 96/19 |
| 3,745,749 | A | * | 7/1973 | Gelfand | 96/21 |
| 3,772,853 | A | * | 11/1973 | Burge et al. | 96/21 |
| 3,959,715 | A | * | 5/1976 | Canning | 96/24 |
| 3,984,215 | A | * | 10/1976 | Zucker | 95/81 |
| 4,133,649 | A | * | 1/1979 | Milde | 95/80 |

(Continued)

FOREIGN PATENT DOCUMENTS

| | | | | | |
|---|---|---|---|---|---|
| DE | 4338017 | A1 | * | 10/1994 | B03C 3/40 |
| GB | 2086673 | A | * | 5/1982 | B03C 3/68 |

(Continued)

OTHER PUBLICATIONS

European Search Report, EP Patent Application No. 10166579.2, Completed Feb. 24, 2011, The Hague.

(Continued)

*Primary Examiner* — Duane Smith
*Assistant Examiner* — Sonji Turner
(74) *Attorney, Agent, or Firm* — Rita D. Vacca

(57) ABSTRACT

The disclosure relates to an electrostatic precipitator unit with at least two individual power supplies (11) for pulsed operation of electrostatic static precipitators, wherein the power supplies (11) are powered by a common feeding (1), wherein each power supply (11) comprises a control unit (23), and wherein the control units are at least indirectly connected by communication lines (32) allowing for a controlled relative scheduling of the pulsed operation of the individual power supplies (11).

13 Claims, 6 Drawing Sheets

(56) References Cited

U.S. PATENT DOCUMENTS

| | | | | | |
|---|---|---|---|---|---|
| 4,209,306 | A | * | 6/1980 | Feldman et al. | 95/80 |
| 4,255,775 | A | * | 3/1981 | Andrews | 96/25 |
| 4,284,417 | A | * | 8/1981 | Reese et al. | 95/3 |
| 4,290,003 | A | * | 9/1981 | Lanese | 323/241 |
| 4,311,491 | A | * | 1/1982 | Bibbo et al. | 95/7 |
| 4,390,830 | A | * | 6/1983 | Laugesen | 323/237 |
| 4,390,831 | A | * | 6/1983 | Byrd et al. | 323/240 |
| 4,400,662 | A | * | 8/1983 | Coe, Jr. | 323/320 |
| 4,410,849 | A | * | 10/1983 | Ando | 323/237 |
| 4,413,225 | A | * | 11/1983 | Donig et al. | 323/246 |
| 4,414,603 | A | * | 11/1983 | Masuda | 361/227 |
| 4,432,061 | A | * | 2/1984 | Herklotz et al. | 700/298 |
| 4,445,911 | A | * | 5/1984 | Lind | 95/6 |
| 4,503,477 | A | * | 3/1985 | Henriksen et al. | 361/2 |
| 4,558,404 | A | * | 12/1985 | James | 96/82 |
| 4,613,346 | A | * | 9/1986 | Reyes et al. | 95/3 |
| 4,644,439 | A | * | 2/1987 | Taarning | 361/87 |
| 4,659,342 | A | * | 4/1987 | Lind | 95/5 |
| 4,670,829 | A | * | 6/1987 | Dallhammer et al. | 96/25 |
| 4,698,719 | A | * | 10/1987 | Taarning | 361/87 |
| 4,996,471 | A | * | 2/1991 | Gallo | 323/241 |
| 5,378,978 | A | * | 1/1995 | Gallo et al. | 323/241 |
| 5,542,967 | A | * | 8/1996 | Ponizovsky et al. | 96/82 |
| 5,601,633 | A | * | 2/1997 | Ponizovsky et al. | 95/81 |
| 5,707,422 | A | * | 1/1998 | Jacobsson et al. | 95/6 |
| 6,287,368 | B1 | * | 9/2001 | Ilmasti | 96/19 |
| 6,329,765 | B1 | | 12/2001 | Kanno | |
| 6,461,405 | B2 | * | 10/2002 | Reyes | 95/7 |
| 6,667,875 | B1 | * | 12/2003 | Hartmann | 361/235 |
| 6,937,455 | B2 | * | 8/2005 | Krichtafovitch et al. | 361/230 |
| 7,081,152 | B2 | * | 7/2006 | Altman et al. | 95/5 |
| 7,594,958 | B2 | * | 9/2009 | Krichtafovitch et al. | 96/18 |
| 2001/0011499 | A1 | * | 8/2001 | Reyes | 95/7 |
| 2004/0004440 | A1 | * | 1/2004 | Krichtafovitch et al. | 315/111.91 |
| 2004/0004797 | A1 | * | 1/2004 | Krichtafovitch et al. | 361/91.1 |
| 2006/0055343 | A1 | * | 3/2006 | Krichtafovitch et al. | 315/291 |
| 2009/0129124 | A1 | * | 5/2009 | Ranstad | 363/17 |

FOREIGN PATENT DOCUMENTS

| | | | | |
|---|---|---|---|---|
| WO | WO 0016906 | A1 | * | 3/2000 |
| WO | 2009008449 | A1 | | 1/2009 |
| WO | WO 2009 008449 | | * | 1/2009 |

OTHER PUBLICATIONS

International Search Report and Written Opinion, International Searching Authority, Completed Sep. 7, 2012.

* cited by examiner

METHOD TO CONTROL THE LINE DISTORATION OF A SYSTEM OF POWER SUPPLIES OF ELECTROSTATIC PRECIPITATORS

This is a US National Phase application claiming priority to International Application No. PCT/EP2011/060136 having an International Filing Date of Jun. 17, 2011, incorporated herein in its entirety by reference.

TECHNICAL FIELD

The present invention relates to an electrostatic precipitator unit with at least two individual power supplies for pulsed operation of electrostatic precipitators, wherein the power supplies are powered by a common feeding. The invention further relates to methods of operation of such an electrostatic precipitator unit.

PRIOR ART

With the increasing concern for environmental pollution, the reduction of particle emissions by using Electrostatic Precipitators (ESPs) is a highly important issue for coal fired power plants. ESPs are highly suitable dust collectors. Their design is robust and they are very reliable. Moreover, they are most efficient. Degrees of separation above 99.9% are not unusual. When compared with fabric filters, their operating costs are low and their risk of damage and stoppage owing to functional disorders is considerably smaller. They are a natural choice in many cases. In an ESP, polluted gas is conducted between electrodes connected to an ESP power supply. Usually, this is a high-voltage transformer with thyristor control on the primary side and a rectifier bridge on the secondary side. This arrangement is connected to the ordinary AC mains and thus is supplied at a frequency, which is 50 or 60 Hz. Power control is effected by varying the firing delays of the thyristors. The smaller the firing angle, i.e., the longer the conducting period, the more current supplied to the ESP and the higher the voltage between the electrodes of the ESP. Modern ESPs are divided into several bus sections to increase collection efficiency. Each of these bus sections has its own power supply (PS), which is controlled individually and has a typical output power range of 10-200 kW and an output voltage range of 30-150 kVDC.

Modern ESP's power supplies are often based on resonant converters because of the transformer's shortcomings and to have soft switching for a wide operation range. One exemplary power supply for ESP's is known from US 2009/0129124.

SUMMARY OF THE INVENTION

Modern ESP's are often operated in pulsed mode. Pulsed operation of an electrostatic precipitator considerably influences the mains power quality, since it can result in high line current distortion (total harmonic distortion) and unbalanced mains phase loading. Thus, interruption and malfunction of equipment fed by a common feeding, audible noise, heating in transformers, generators and power lines, electric resonance in the mains, and mechanical oscillations in generators, engines, etc., can be caused. These problems can become worse if, for example, a group of power supplies with pulsed operation are fed by a common feeding, since the pulses in different supplies can occur at the same instant. On the other hand, if the pulses in each power supply are scheduled in an optimal way it should be possible to reduce the undesirable effects in this type of operation, so that the power consumption becomes more continuous in time. At the moment, the power supply systems for ESP application do not use a strategy for pulse scheduling and don't allow for such. Therefore, arbitrary current waveform at the input occurs.

This is where the present invention has its origin, proposing a new and improved electrostatic precipitator setup for the operation of at least two power supplies connected to a common feeding. The power supplies provide pulsed power output for pulsed operation of one or several ESPs operated with said power supplies.

So, this invention deals with mains' energy quality optimization for a group of power supplies feeding an Electrostatic Precipitator (ESP) with pulsed operation.

The modified electrostatic precipitator device and the corresponding optimization strategy that will be presented herein, can be applied to any group of power supplies operating in pulsed mode. Thereby, a considerable improvement of the line current by just controlling the starting time of the different pulses can be achieved without any additional means.

The "best case" for an ESP system occurs when all supplies at full load operate feeding the ESP with continuous power, when the mains' phase currents are balanced, and when the relation between the average value of the power consumption and the harmonic components are at the lowest. Considering this, the main idea of this optimization is to allow arrangement of the pulses in an optimal sequence, so that the group of pulsed power supplies has similar line behaviour to that of an equivalent single power supply operating in continuous mode.

So, one of the cores of the invention can be summarized as provided below.

The proposed modified electrostatic precipitator unit allows arrangement of the pulses of the individual power supplies in an optimal sequence by shifting the initial pulses of each power supply by a delay time with respect to one reference. The aim is essentially to provide a structure, which enables filling of the gaps between the reference pulses with the pulses of the other power supplies.

Best behavior is observed when the pulses are essentially uniformly distributed within the reference pulse period and by shifting all pulses of one field by the same delay with respect to the other fields.

More specifically, the present invention relates to an electrostatic precipitator unit with at least two individual power supplies for pulsed operation of electrostatic precipitators, wherein the power supplies are powered by a common feeding (mains).

In accordance with the present invention, each individual power supply comprises a control unit, and these individual control units are at least indirectly connected among each other by communication lines allowing for a controlled relative scheduling of the pulsed operation of the individual power supplies.

The power supplies of the unit, which are powered by a common feeding, can be powering at least two individual electrostatic precipitators, e.g., each being part of a different exhaust duct. In each of these ducts, there may be several bus sections powered by individual independent power supplies also powered by a common feeding.

According to another embodiment, the power supplies are part of one electrostatic precipitator, typically powering different bus sections thereof or powering different modules within one bus section.

The control may be realised in the unit either in a manner such that there is communication lines between the individual control units and one control unit takes the lead and controls the relative scheduling, or this control is shared between the control units forming part of individual power supplies. On the other hand, it is also possible and in accordance with another preferred embodiment of the present invention, that the unit further comprises a control computer (which can be dedicated computer, or which can be a computer also dealing with other tasks in the precipitator or in the power plant) connected to the communication lines and controlling the scheduling of the power supplies.

The relative scheduling of the pulsed operation of the individual power supplies can be effected in that one power supply is defined to be the reference power supply, and the initial pulses of each further power supply are shifted by controlled delays with respect to the pulses of the reference power supply, so as to fill the gaps between the reference pulses with the pulses of the further power supplies. In this case, the controlled delays can be determined so as to essentially uniformly distribute the pulses of the further power supplies in the pulse period of the reference power supply, wherein preferably, if the accumulated pulse width of all power supplies is smaller than the largest pulse period, the controlled delays are determined such that the gaps between all pulses are essentially identical, if the accumulated pulse width of all power supplies is equal to the largest pulse period the controlled delays are determined such that there are no gaps between pulses, and if the accumulated pulse width of all power supplies is larger than the largest pulse period, the overlap length of all pulses is equal.

Typically the power supplies used in this context are high voltage transformer based, preferably IGBT (integrated gate bipolar transistor) based converters, preferably series loaded resonant converters allowing for high power and high voltage, preferably said high power being in a range of 10-200 kW and/or said high voltage being in a range of 50-150 kV DC.

According to yet another preferred embodiment, the system is adapted to operate with DC pulses provided to the electrostatic precipitators having pulse widths in the range of 0.1-20 ms, and/or having pulse periods in the range of 0.5 ms-2 s, wherein preferably the pulse ratio defined as the pulse width divided by the pulse period is in the range of 1-½000.

The electrostatic precipitator may comprise at least one bus section for pulsed operation and at least one further bus section for continuous operation.

Furthermore the unit may, in accordance with another preferred embodiment, comprise at least three power supplies, preferably at least four power supplies, most preferably at least six power supplies, preferably all of them connected and powered by a common feeding and at least indirectly connected by communication lines. In case of large precipitator units, there may be up to 24 or even 36 power supplies or more, which are individually controlled and scheduled, with all powered by a common feeding.

Furthermore, the present invention relates to an industrial application comprising an electrostatic precipitator unit as described above, e.g., a power plant, preferably a fossil fuel operated power plant, most preferably a coal operated power plant, the exhaust gases from which are cleaned by the electrostatic precipitator unit. The electrostatic precipitator unit can also be used for another dust producing process, such as a sinter band sieving system, a cement manufacturing process, or the like.

In addition to the above, the present invention relates to a method for the operation of a unit as outlined above, wherein preferably one power supply is defined to be the reference power supply, and wherein the initial pulses of each further power supply are shifted by controlled delays with respect to the pulses of the reference power supply, so as to fill the gaps between the pulses of the reference power supply with the pulses of the further power supplies, and wherein preferentially the reference power supply is the power supply of the system which has the largest pulse period.

According to a preferred embodiment of this method, the controlled delays are determined so as to essentially uniformly distribute the pulses of the further power supplies in the pulse period of the reference power supply, wherein preferably, if the accumulated pulse width of all power supplies is smaller than the largest pulse period, the controlled delays are determined such that the gaps between all pulses are essentially identical, if the accumulated pulse width of all power supplies is equal to the largest pulse period the controlled delays are determined such that there are no gaps between pulses, and if the accumulated pulse width of all power supplies is larger than the largest pulse period, the overlap length of all pulses is equal.

Further embodiments of the invention are laid down in the dependent claims.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DESCRIPTION OF PREFERRED EMBODIMENTS

Usually, an ESP system is divided into several bus sections to improve particulate collection efficiency. In small systems, only 2 or 3 bus sections are connected in series, and in large ones, several bus sections are connected in parallel and in series. Different power supplies with different power ratings often energize the bus sections in order to optimize the collection efficiency of a single bus section.

Figure 1:
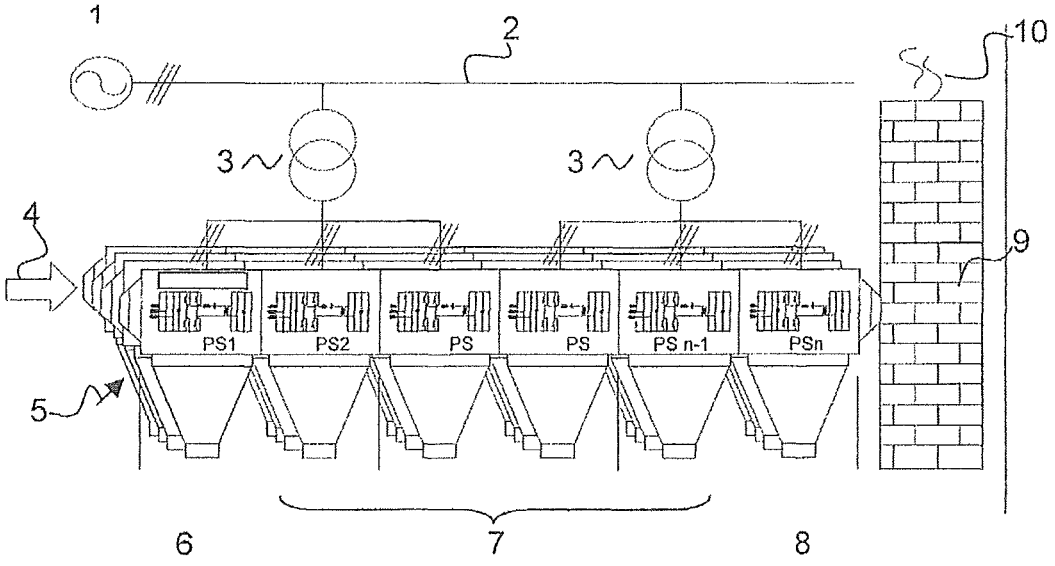
FIG. 1 shows a typical ESP installation scheme, specifically a system with several sequential bus sections driven by 24 power supplies.

FIG. 1 shows a typical ESP installation with several sequential bus sections driven by 24 power supplies. The electrostatic precipitator 5 comprises an inlet side through which a gas flow 4 loaded with particles, e.g., coal dust, enters the ESP. The ESP has an inlet field 6, followed by middle fields 7, and terminates with an outlet field 8, the outlet of which is connected to a stack 9 through which the cleaned exhaust gas 10 exits to the environment. So the ESP is mechanically sectionalized in series connected fields and parallel connected cells for collection efficiency. Each field/cell position is called a bus section. One ESP power supply is feeding a single bus section with high voltage.

Each of the fields 6-8 has two rows of individually powered precipitator systems (four cells and six fields), leading to 24 bus sections, and to this end, 24 power supplies (PS) are provided to energize the precipitators. The general topology of such a power supply will be discussed further below. The power supplies are energized via the common feeding 1, which via a low or medium voltage line 2 and distribution transformers 3 connects to the individual power supplies. In other words, the totality of the power supplies is connected to a common feeding system 1, and if these power supplies or at least a fraction thereof are operated in pulsed mode, the load on the main can be heavily unbalanced.

Figure 2A:
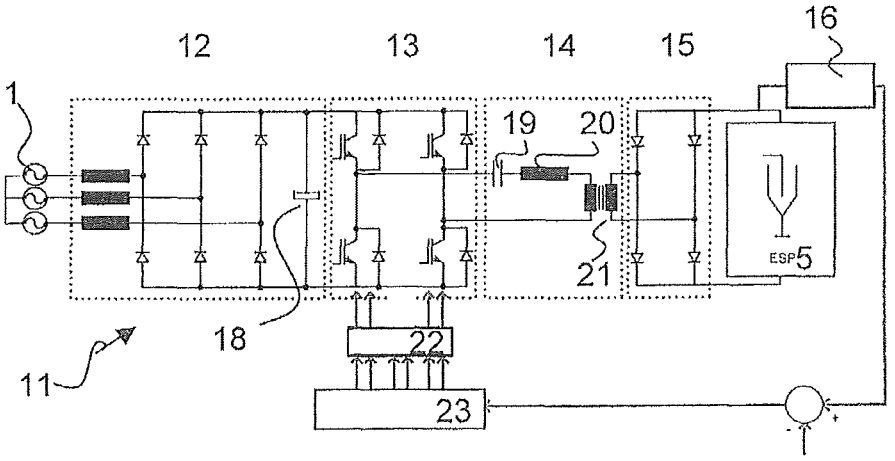
FIG. 2A shows a schematic of a single high frequency ESP power supply, FIG. 2B a schematic of a typical single phase mains frequency ESP power supply, and FIG. 2C a schematic of a high frequency power processing ESP power supply.

A high frequency, three-phase mains power supply 11 for powering one of the individual precipitators in a setup according to FIG. 1 is illustrated in FIG. 2A. On the input side, the power supply 11 is connected to the mains 1 and first comprises an input rectifier 12. At the output side of the input rectifier 12, a direct current (DC) is provided and between the levels there is located a DC link capacitor 18. This direct current is then fed through a full bridge inverter 13 with a number of correspondingly fired transistors. The operation of the full bridge inverter 13 is controlled by drivers 22, in turn controlled by a control unit 23. The alternating current on the output side of the full bridge inverter 13 enters a resonant tank and transformer unit 14. The resonant circuit is given by a series arrangement of a capacitor 19 and an inductor 20 followed by a transformer 21. On the output side, the unit 14 is coupled to an output rectifier 15, the output side of which is then coupled to the electrodes of the electrostatic precipitators 5.

For pulsed operation of such a power supply, the full bridge inverter is operated in pulsed mode via the control unit 23 and the drivers 22. In order to control the whole system, there is provided a current and voltage sensor 16, the output of which is used for controlling the unit 23.

Figure 2B:
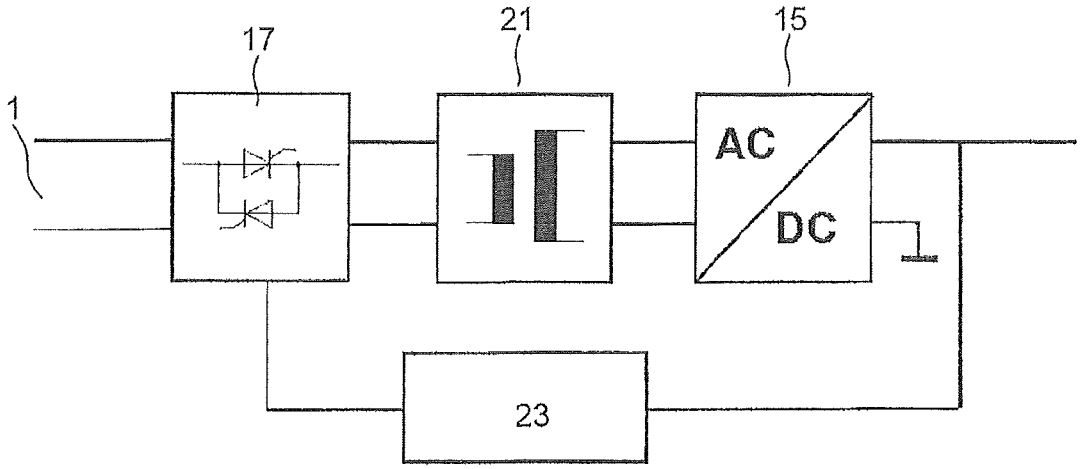
Figure 2C:
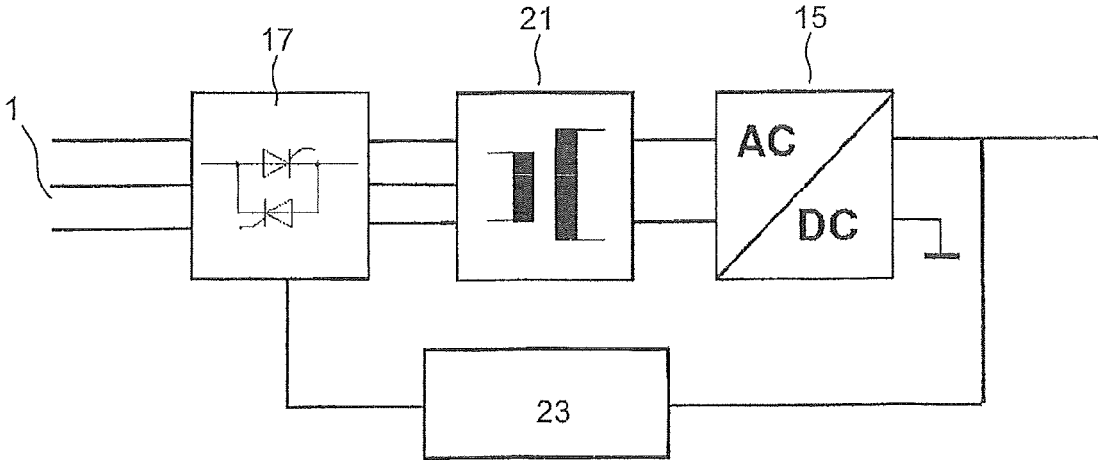

The present invention is not limited to high frequency, three-phase power supplies as illustrated in FIG. 2A, and also further schematically in FIG. 2C, which typically operate at a frequency in the resonant tank in the 20-200 kHz range. Also possible are mains frequency power processing units as illustrated in FIG. 2B, where a single phase mains 1 is switched in unit 17, transformed by a transformer 21, and rectified for final use at the ESP after the output rectifier 15.

Figure 3:
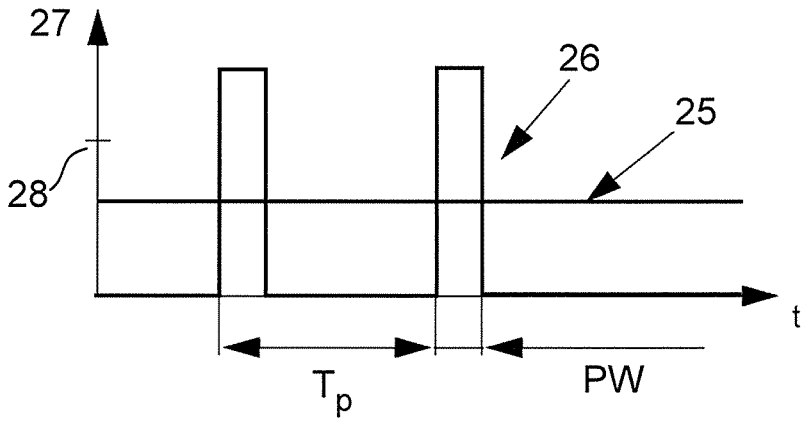
FIG. 3 schematically shows the pulsed and continuous charging method.

The charging method for each ESP power supply 11 can be either a continuous mode 25 or a pulsed mode 26 of current 27; see FIG. 3. The continuous charging method can be used in most processes where low resistivity dust is collected. The pulsed charging method is used when the dust has a medium or high resistivity, or in order to save power consumption for same dust collection efficiency. Each ESP power supply is individually optimized during pulsed mode operation.

Figure 4:
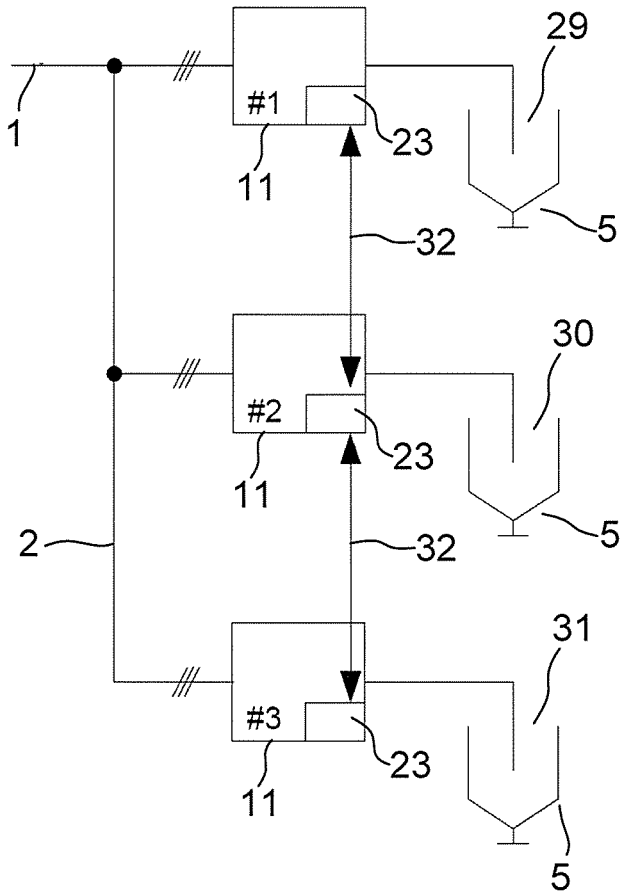
FIG. 4 shows a group of three ESP power supplies.

Problems occur when a group of ESP power supplies 11 are operating in pulsed charging mode and fed by the same mains 1, as illustrated in FIG. 4. Here three individual power supplies, i.e., #1, #2 and #3, are powered by the distribution line 2 by a common feeding. Each power supply drives an individual bus section 29, 30, 31, respectively, of the electrostatic precipitator 5. Generally speaking the bus sections can either be part of one single electrostatic precipitator, or they may be parts of different electrostatic precipitators. Each of the power supplies 11 comprises an individual control unit 23 responsible for the control of pulses via the above-mentioned full bridge inverter 13. The individual control units 23 are interconnected via communication lines/control lines 32. In accordance with the invention, these lines 32 are used to provide control scheduling of the pulse trains of the individual power supplies in order to minimise distortions and to optimise the load on the mains.

Figure 5:
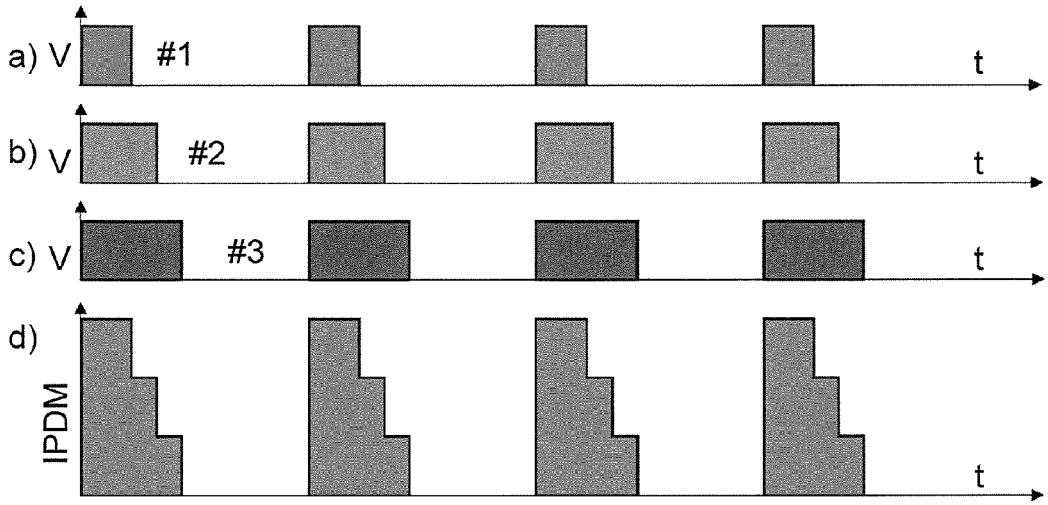
FIG. 5 a) shows the pulse train in power supply #1, b) power supply #2, c) power supply #3, and d) the total power drained from the power grid.

The current pulse from each ESP power supply has variable pulse width PW and variable pulse period time $T_P$ as defined in FIG. 3. These parameters are optimized based on either manual or automatic tuning principles for each power supply individually. Due to that each ESP power supply controller unit 23 is individually optimizing the current pulse parameters, pulses from different ESP power supplies are, however, according to the state-of-the-art, not coordinated and may occur at the same instant, which is illustrated in FIG. 5. The pulse period in FIG. 5 is 9 ms for all three ESP power supplies #1-#3 for simplicity, but still a realistic example. The pulse width is 2 ms for power supply #1, 3 ms for power supply #2 and 4 ms for power supply #3 in this first example.

The example in FIG. 5 is showing the instantaneous moment when all ESP power supplies are pulsing simultaneously, i.e., starting at the same moment in time. This leads to the repetitive pattern of the instant power drained (IPDM) from the mains as illustrated in FIG. 5 d). Normally there is a continuous drift between the ESP power supplies pulsing, giving rise to a discontinuous draining of current from the power grid.

Figure 6:
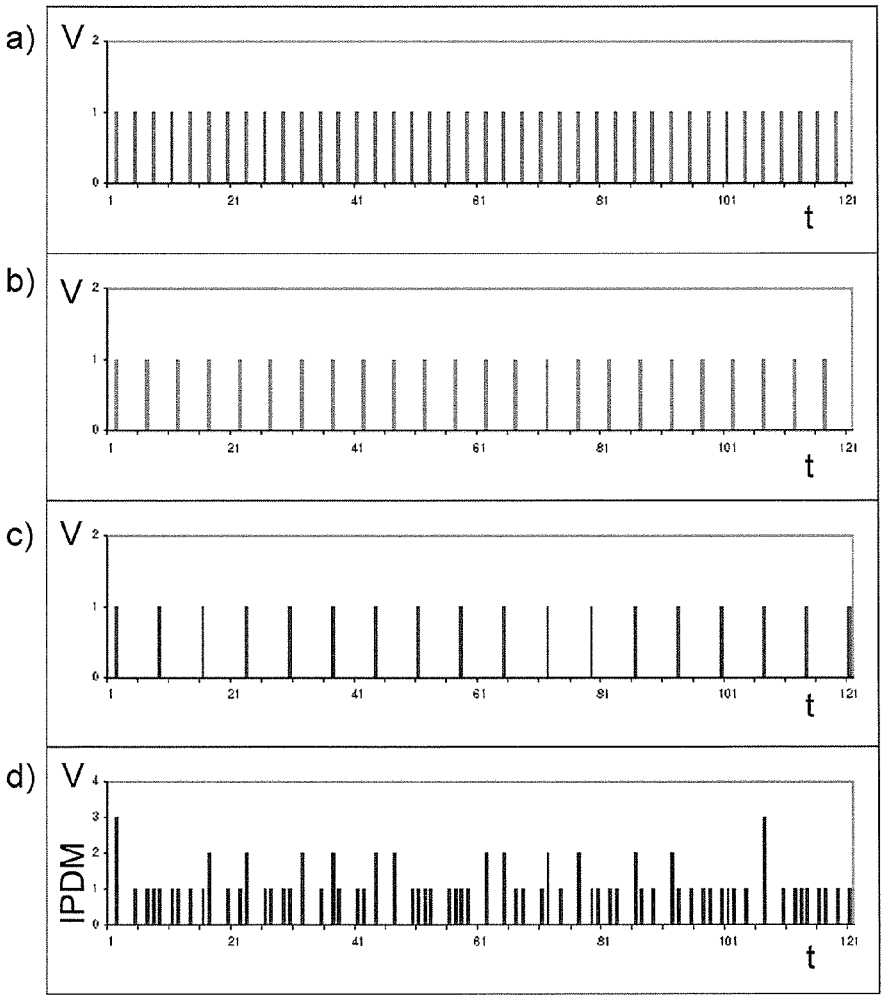
FIG. 6 shows for a second example in a) an ESP power supply #1 with a pulse ratio 1/3, b) an ESP power supply #2 with a pulse ratio 1/5, c) an ESP power supply #3 with a pulse ratio 1/7, and d) the total power drained from the power grid.

The second example illustrated in FIG. 6 is showing three ESP power supplies that are pulsing with different pulse ratios. The pulse ratio is defined as the relationship between the pulse width and the pulse period. The resulting problem with pulsed mode operation of the ESP is that the line currents will show a high Total Harmonic Distortion (THD), subharmonics, unbalanced phase load, and even a DC component in the line current. In this case, interruption and malfunction of equipment connected to the same energy system, audible noise, heating in transformers, generators and power lines, electric resonance in the mains, and mechanical oscillations in generators, engines, etc., can be generated.

Figure 7:
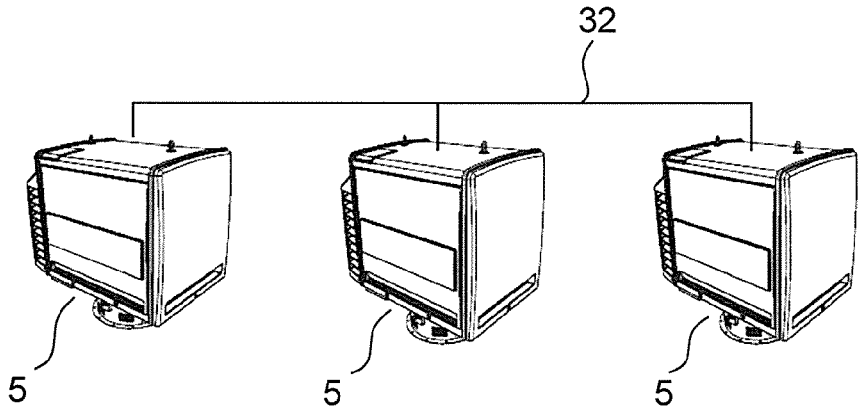
FIG. 7 shows a setup with direct communication between individual ESPs powered by a common feeding.

The proposed solution is that the different ESP power supplies or groups of ESP power supplies communicate as illustrated in FIG. 4 via lines 32 or as illustrated for a situation where three individual precipitators are controlled in FIG. 7. In such a way, the occasions for the pulses are adjusted (scheduling) so that the power flow is as even as possible.

Figure 8:
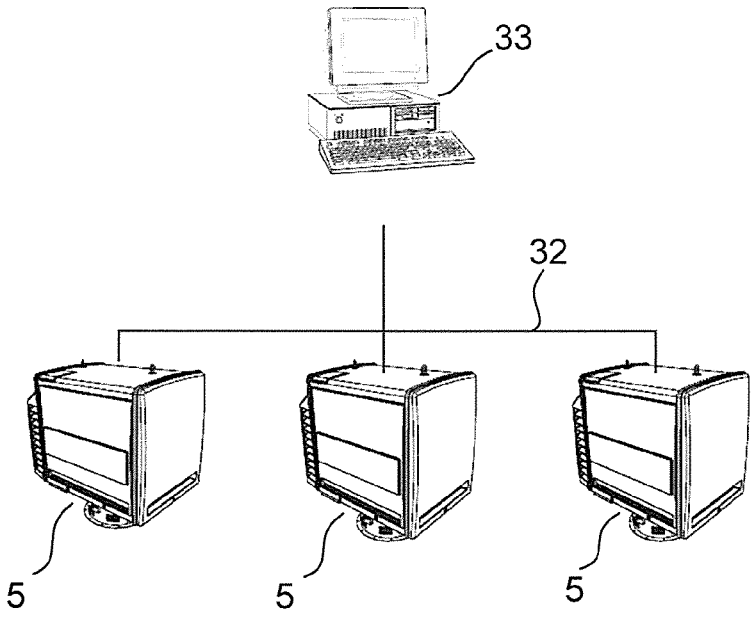
FIG. 8 shows a setup with communication via a host computer between individual ESPs powered by a common feeding.

A different approach for the communication interface can be to use a dedicated host computer, for managing the time slots for the controller unit in each local ESP power supply. FIG. 8 shows a setup where there is provided such a dedicated control computer 33 controlling the scheduling in the individual precipitators 5.

Figure 9:
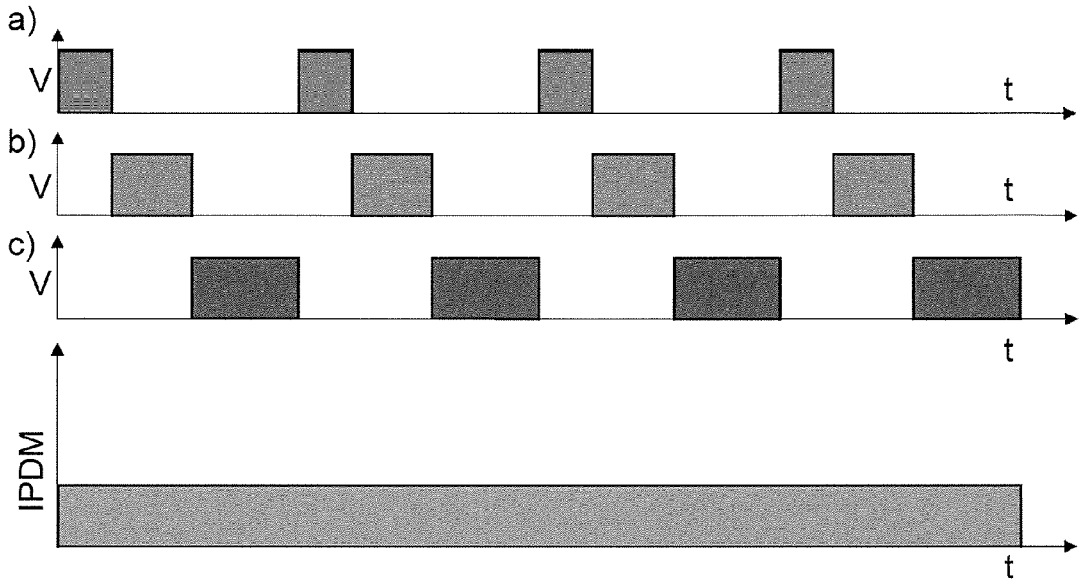
FIG. 9 shows an optimized third example the corresponding pulse train in a) power supply #1, b) power supply #2, c) power supply #3, and d) the total power drained from the power grid.

The variation in the power flow can be minimized by using a line distortion optimization algorithm in each local controller. The purpose is to limit the number of pulses from different ESP power supplies that occurs at the same instant; see FIG. 9. The pulse period in FIG. 9 is chosen to be 9 ms for all ESP power supplies for simplicity, and the pulse widths in FIG. 9 a), b), and c) are the same as described in relation with FIG. 5 a), b), and c) respectively, but still a realistic example. One can see that the instant power drained from the mains becomes essentially completely homogeneous over time for this particular situation where the sum of the pulse widths of the individual power supplies is equal to the pulse period.

To summarise what distinguishes the invention from existing technologies is that:

there are controllers in the ESP power supplies;

there is provided means for communication between the local controllers, as controller units are exchanging information on timing for pulsing and for delay in order to avoid/minimize simultaneous pulsing in different bus sections; and there is adjustment of the pulse occasions so that line distortion is minimized. (Line distortion optimizing algorithm).

This allows to solve at least the following problems:

possibility to meet the line distortion standards in pulsed mode operation;

reduction of excessive losses in the grid, power cables and feeding transformers; and reduced risk for malfunction of other equipment due to line distortion.

LIST OF REFERENCE SIGNS

1 mains, common feeding
2 low or medium voltage level line
3 distribution transformer
4 gas flow loaded with particles, e.g., coal dust
5 electrostatic precipitator
6 inlet field
7 middle fields
8 outlet field
9 stack
10 cleaned exhaust gas
11 power supply
12 input rectifier
13 full bridge inverter
14 resonant tank and transformer
15 output rectifier
16 current and/or voltage sensor
17 thyristor blocks
18 DC link capacitor
19 capacitor in series
20 inductor in series
21 transformer
22 drivers
23 control unit
25 current for continuous operation
26 current for pulsed operation
27 secondary current
28 current limit
29 bus section 1
30 bus section 2
31 bus section 3
32 communication line
33 control computer
t time
$T_P$ pulse period, intra-pulse delay
PW pulse width
IPDM instant power drained from the mains
V voltage
#1 ESP power supply number 1
#2 ESP power supply number 2
#3 ESP power supply number 3

The invention claimed is:

1. An electrostatic precipitator unit comprising:

electrostatic precipitators;

at least two individual power supplies for a pulsed operation of the electrostatic precipitators;

a common feeding powering the power supplies; and a control unit for each of the power supplies at least indirectly connected by communication lines for a controlled relative scheduling of a pulsed operation of the individual power supplies.

2. The electrostatic precipitator unit according to claim 1, wherein each of the power supplies power at least two individual electrostatic precipitators with each of the at least two individual electrostatic precipitators comprising more than one independent power supplies.

3. The electrostatic precipitator unit according to claim 1, wherein the power supplies are a part of one of the at least two individual electrostatic precipitators to power individual bus sections or fields thereof.

4. The electrostatic precipitator unit according to claim 1, wherein the unit further comprises a control computer connected to the communication lines of the power supplies for scheduling control.

5. The electrostatic precipitator unit according to claim 1, wherein the controlled relative scheduling of the pulsed operation of the individual power supplies is effected by one power supply defined as a reference power supply, and initial pulses of each further power supply shifts by controlled delays to pulses of the reference power supply to fill the gaps between the pulses of the reference power supply by pulses of the further power supplies.

6. The electrostatic precipitator unit according to claim 5, wherein the controlled delays are determined by the control unit to uniformly distribute the pulses of the further power supplies in the gaps between pulses of the reference power supply (pulse period), and if an accumulated pulse width of all power supplies is smaller than a largest pulse period, controlled delays are set by the control unit so gaps between all pulses are equal, if the accumulated pulse width of all power supplies is equal to the largest pulse period, controlled delays are set by the control unit for no gaps between pulses, and if the accumulated pulse width of all power supplies is larger than the largest pulse period, controlled delays are set so overlap length of each pulse is equal.

7. The electrostatic precipitator unit according to claim 1, wherein the power supplies are single- or three-phase, 50 Hz or 60 Hz based power supplies, high voltage transformer based, integrated gate bipolar transistor (IGBT) based converters, series loaded resonant converters for high power and high voltage, said high power in a range of 10-200 kW or said high voltage in a range of 50-150 kV DC.

8. The electrostatic precipitator unit according to claim 1, wherein the unit operates with DC pulses provided to the electrostatic precipitators with pulse widths in a range of 0.1-20 ms, or having pulse periods in a range of 0.5 ms-2 s, wherein a pulse ratio of pulse width divided by pulse period is 1 to 1/2000.

9. The electrostatic precipitator unit according to claim 1, wherein the electrostatic precipitator comprises at least one bus section for pulsed operation and at least one further bus section for continuous operation.

10. The electrostatic precipitator unit according to claim 1, wherein the unit comprises at least three to six power supplies, each connected and powered by a common feeding and at least indirectly connected by communication lines.

11. An industrial application, power plant, fossil fuel operated power plant, or coal operated power plant comprising:

an electrostatic precipitator unit according to claim 1, for cleaning exhaust gases from said application or plant.

12. A method of operating an electrostatic precipitator unit comprising:

defining one power supply as a reference power supply, and shifting initial pulses of each further power supply by controlled delays from pulses of the reference power supply to fill gaps between the pulses of the reference power supply by pulses of the further power supplies, wherein the reference power supply is the power supply of the unit with largest gaps between pulses (pulse period).

13. Method according to claim 12, wherein the controlled delays are set to uniformly distribute the pulses of the further power supplies in the pulse period of the reference power supply, and, if an accumulated pulse width of all power supplies is smaller than a largest pulse period, the controlled delays are set so gaps between pulses are equal, if the accumulated pulse width of all power supplies is equal to the largest pulse period, the controlled delays are set for no gaps between pulses, and if the accumulated pulse width of all power supplies is larger than the largest pulse period, the controlled delays are set so overlap length of each pulse is equal.

* * * * *